US008920146B2

(12) United States Patent
Heinrichs

(10) Patent No.: US 8,920,146 B2
(45) Date of Patent: Dec. 30, 2014

(54) PUMP SYSTEM

(75) Inventor: Albrecht Heinrichs, Erkelenz (DE)

(73) Assignee: MHwirth GmbH, Erkelenz (DE)

( * ) Notice: Subject to any disclaimer, the term of this patent is extended or adjusted under 35 U.S.C. 154(b) by 0 days.

(21) Appl. No.: 13/457,519

(22) Filed: Apr. 27, 2012

(65) Prior Publication Data

US 2012/0244020 A1 Sep. 27, 2012

Related U.S. Application Data

(63) Continuation-in-part of application No. 11/918,310, filed as application No. PCT/EP2006/001400 on Feb. 16, 2006, now Pat. No. 8,186,977.

(30) Foreign Application Priority Data

Apr. 12, 2005 (DE) ..... 10 2005 016 884

(51) Int. Cl.

| | |
|---|---|
| ***F04B 11/00*** | (2006.01) |
| ***F04B 17/00*** | (2006.01) |
| ***F04B 47/02*** | (2006.01) |
| ***F04B 9/02*** | (2006.01) |
| ***F04B 23/00*** | (2006.01) |

(52) U.S. Cl.

CPC . *F04B 9/02* (2013.01); *F04B 47/02* (2013.01); *F04B 23/00* (2013.01)

USPC ..... 417/539; 417/415

(58) Field of Classification Search

CPC ..... F04B 9/02; F04B 35/01; F04B 53/006; F04B 53/16

USPC ..... 417/415, 521, 539; 92/73, 147

See application file for complete search history.

(56) References Cited

U.S. PATENT DOCUMENTS

| | | | | |
|---|---|---|---|---|
| 879,560 | A * | 2/1908 | Lepley | 417/536 |
| 2,108,958 | A * | 2/1938 | Brightwell | 417/539 |
| 2,131,749 | A * | 10/1938 | Ofeldt | 417/506 |
| 2,137,552 | A * | 11/1938 | Valentine | 74/596 |
| 2,331,513 | A | 10/1943 | Stahl et al. | |
| 2,755,739 | A | 7/1956 | Euwe | |
| 2,899,247 | A | 8/1959 | Clarkson et al. | |
| 4,009,971 | A * | 3/1977 | Krohn et al. | 417/43 |
| 4,118,151 | A | 10/1978 | Murakami et al. | |
| 4,497,614 | A * | 2/1985 | Frink | 417/238 |
| 2004/0028540 | A1 | 2/2004 | Peck | |
| 2004/0060717 | A1 | 4/2004 | Leppanen | |
| 2004/0213677 | A1 | 10/2004 | Matzner et al. | |
| 2004/0219040 | A1 * | 11/2004 | Kugelev et al. | 417/415 |

FOREIGN PATENT DOCUMENTS

| | | |
|---|---|---|
| DE | 32 44 822 A1 | 6/1983 |
| GB | 1 034 058 A | 6/1966 |

* cited by examiner

*Primary Examiner* — Peter J Bertheaud

(74) *Attorney, Agent, or Firm* — Norman B. Thot

(57) ABSTRACT

A pump system configured to deliver drilling fluid in at least one of a driving well and a drilling well includes a pump unit, a rotary drive device configured to drive the pump unit, and a gearbox comprising a driving gear and an driven gear. The rotary drive device is operatively connected to the pump unit by the gearbox.

18 Claims, 6 Drawing Sheets

PUMP SYSTEM

CROSS REFERENCE TO PRIOR APPLICATIONS

This application is a continuation in part of application Ser. No. 11/918,310, filed on Dec. 3, 2007, which is a U.S. National Phase application under 35 U.S.C. §371 of International Application No. PCT/EP2006/001400, filed on Feb. 16, 2006 and which claims benefit to German Patent Application No. 10 2005 016 884.1, filed on Apr. 12, 2005. The International Application was published in German on Oct. 19, 2006 as WO 2006/108466 A1 under PCT Article 21(2).

FIELD

The present invention relates to a pump system for conveying rinse fluid in advancing wells or drilling wells, having a pump unit and a rotary drive device for driving the pump unit.

BACKGROUND

In particular in driving or putting down big-hole wells, drilling fluid is supplied to the well during the drilling operation. The drilling fluid serves on the one hand to lubricate the drilling tools working at the well face and/or at the bottom hole as well as the support of the drift face and/or the bore surface. On the other hand, with the help of the drilling fluid, loosened drilling chips can also be removed from the well by, for example, supplying fresh drilling fluid in the area of the well face and/or the bottom hole through a hollow drill string, thereby creating a stream of drilling fluid which entrains loosened drill chips and removes the debris from the well.

To create the drilling fluid flow, which is required for such removal, particularly high-performance pump systems are required. The flow rate of such pump systems is usually in the range of maximum 3000 L/min at a pressure of maximum 500 bar.

State-of-the-art pump systems are characterized by a particularly compact design because the rotary drive device of the pump system driving the pump unit is situated above the pump unit and is flange-mounted on the top side of the housing. The rotary drive devices usually have a power level of up to 1700 kW.

To be able to transmit this power and/or the torque supplied by the rotary drive device to the input shaft of the pump unit, it is known that both the shaft of the rotary drive and the drive shaft of the pump may lead out of the respective housing on both sides, so that each shaft has two shaft ends. A chain wheel is mounted in a rotationally fixed mount on each shaft end. The torque is thus transmitted through two chains running parallel to one another.

One disadvantage with such pump systems is that the structural complexity required because of chains running on both sides and the need for components in duplicate and in particular the four-fold shaft bushings required with corresponding sealing arrangements is high. Furthermore, the chain drives create a substantial noise level during operation.

SUMMARY

An aspect of the present invention is to provide a pump system that will avoid the aforementioned disadvantages.

In an embodiment, the present invention provides a pump system configured to deliver drilling fluid in at least one of a driving well and a drilling well which includes a pump unit, a rotary drive device configured to drive the pump unit, and a gearbox comprising a driving gear and a driven gear. The rotary drive device is operatively connected to the pump unit by the gearbox.

BRIEF DESCRIPTION OF THE DRAWINGS

The present invention is described in greater detail below on the basis of embodiments and of the drawings in which.

DETAILED DESCRIPTION

Figure 1:
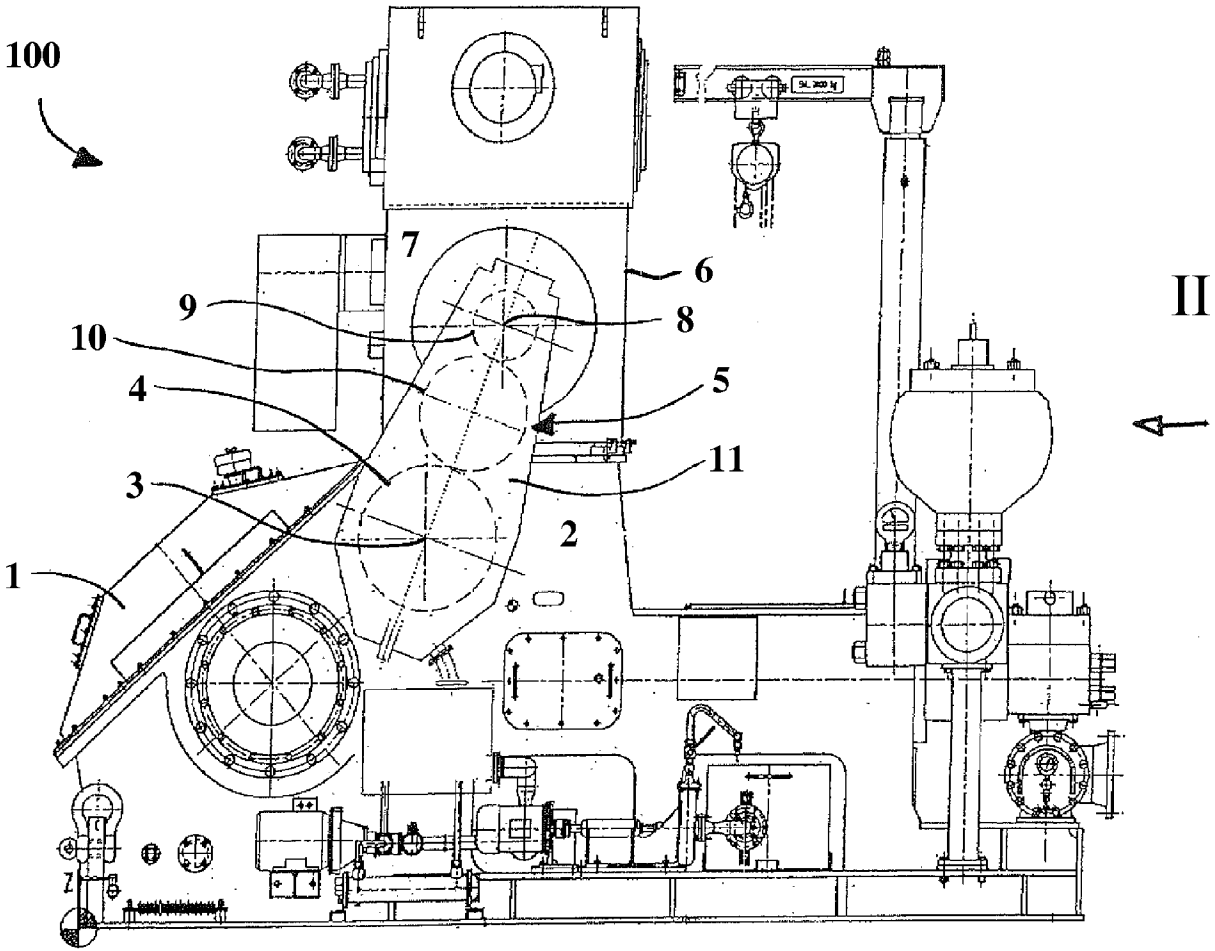
FIG. 1 shows the a first embodiment in a side view.
Figure 2:
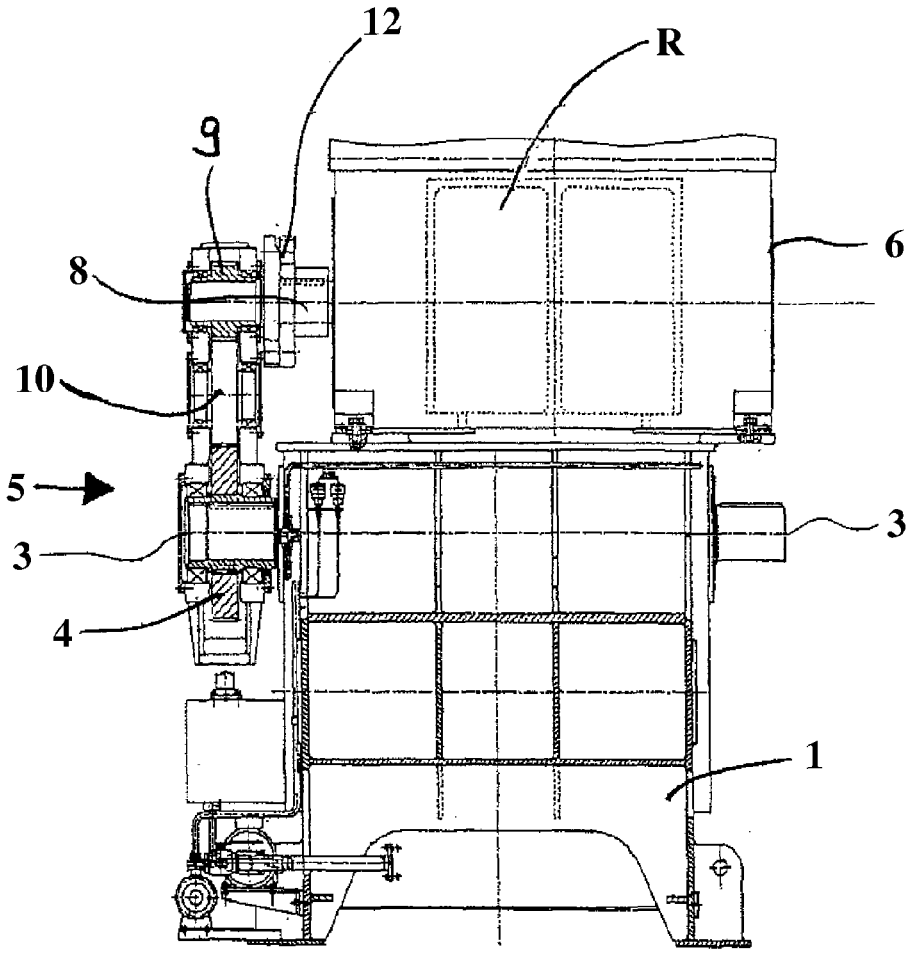
FIG. 2 shows the embodiment of FIG. 1 in a partially sectional view from the front (view II in FIG. 1)

The noise inherently generated with a chain drive is prevented because of the fact that the rotary drive device with the pump system according to the present invention is operatively connected to the pump unit by means of a gearbox comprising a driving gear and an driven gear. Furthermore, it has surprisingly been found that, for transmission of the power and torque required to operate the pump unit, it is sufficient to provide a gearbox on only one side of the pump system.

In an embodiment of the pump system according to the present invention, the rotary drive device can, for example, only have a single shaft end with which the driving gear can be connected rotationally, for example, by means of a clutch.

The noise level caused by the gearbox can further be reduced if, for example, the gear wheels of the gearbox have helical gearing.

In an embodiment of the present invention, the rotary drive device of the pump system which drives the pump unit can, for example, be arranged above the pump unit and can, for example, be flange mounted to the top side of its housing.

In an embodiment of the present invention, the rotary drive device can, for example, be arranged at least almost at the same height as the pump unit. Both the rotary drive device and the pump unit can, for example, be arranged at least almost at ground level. Better accessibility of the rotary drive device, among other things, can be achieved in this way. In comparison with an arrangement of the rotary drive device and the pump unit with one device stacked on top of the other, this reduces load on the housing of the pump unit. This housing is advantageously dimensioned for cost reasons in this embodiment, because it would not withstand stresses that would result from stacking. Another advantage is that the total height of the pump system can, for example, be defined either by the height of the rotary drive device or the height of the pump unit, and is therefore smaller than it would be if these two elements were arranged one on top of the other.

The embodiment in which the rotary drive device is arranged at least almost at the same height as the pump unit can advantageously be a land-based installation in which the slightly larger amount of land area required by the pump system compared with a pump system with a rotary drive device arranged on the pump unit, is less relevant than it would be in the case of an installation on board a ship or supported on a platform.

In the embodiment in which the rotary drive device is arranged at least almost at the same level as the pump unit, the gearbox can, for example, be arranged at least almost horizontally. The gearbox can, for example, have an axis of symmetry which can, for example, be arranged horizontally. The axes of the driving gear and the driven gear can, for example, be at least almost at one level. The axes of the driving gear and the driven gear can, for example, run parallel and, for example, run horizontally.

An especially compact pump system is provided if the rotary drive device is arranged directly adjacent to the pump unit. The lowest possible distance can, for example, prevail between the rotary drive device and the pump unit.

The shape and/or size and/or arrangement of the rotary drive device can, for example, be advantageously selected so that the width of the pump system is defined by the width of the pump unit. The width of the pump system is advantageously not increased significantly by the rotary drive device or is not increased at all.

An especially compact pump system is provided if the rotary drive device has a longer extension running in the direction of the width of the pump system. The rotary drive device thus does not, for example, have a square or circular horizontal projection.

In an embodiment of the present invention, the pump unit can, for example, advantageously have a pump drive shaft. The axis of the shaft of the rotary drive device can, for example, be at the same level as the axis of rotation of the pump drive shaft, in particular in the embodiment in which the rotary drive device is arranged at least almost at the same level as the pump unit. The rotary drive device can, for example, advantageously be arranged adjacent to the pump unit so that the distance between the pump drive shaft and the shaft of the rotary drive device is minimal.

In an embodiment of the present invention, the pump drive shaft is advantageously not the crankshaft of the pump unit.

In an embodiment of the present invention, the driven gear of the gearbox can, for example, be operatively connected to the pump drive shaft. The driven gear can, for example, be connected directly to the pump drive shaft.

In an embodiment of the present invention, the pump unit can, for example, be a pump unit that is known and very well tested per se. This pump unit can, for example, have a housing. In an embodiment of the present invention, it can, for example, have a crankshaft. It can, for example, be constructed so that the pump drive shaft has a pump drive shaft gear wheel, for example, in the interior of the pump housing and the crankshaft has a crankshaft gear wheel, for example, also in the interior of the pump housing. These two gear wheels can, for example, mesh with one another. The pump drive shaft can, for example, protrude from this housing. It can, for example, advantageously be a triple-piston pump (triplex pump). Such a pump unit has long been proven successful and is extremely reliable.

In an embodiment of the present invention, the shaft of the rotational device can, for example, advantageously run parallel to the drive shaft of the pump unit. The drive shaft of the pump unit can, for example, run parallel to the crankshaft of the pump unit.

A modular design of the pump housing can, for example, be simplified because the pump drive shaft protrudes out of the housing.

The rotary drive device can, for example, have a housing, and the housing of the rotary drive device and the pump unit can, for example, be at least almost adjacent to one another.

The gearbox can, for example, advantageously comprise an intermediate gear. The gearbox can, for example, comprise exactly three gear wheels, namely one driving gear, one driven gear and one intermediate gear. The axles of these wheels can, for example, run in a plane, which can, for example, be arranged horizontally. The axles of the aforementioned wheels can, for example, run parallel to one another.

The gearbox can, for example, be advantageously surrounded by a gear box.

In an embodiment of the present invention, the gearbox can, for example, comprise a slip-on gear and/or is formed by a slip-on gear. The gearbox thus forms a unit which is secured only and/or at least predominantly and/or at least substantially by the connection of the driving gear to the shaft of the rotary drive device and/or a clutch and the connection of the driven gear to the pump drive shaft.

In an embodiment of the present invention, the pump system can advantageously be modular and/or constructed according to the modular principle. The modules it can, for example, comprise includes the pump unit, the rotary drive device, the clutch and gear, for example, exclusively. Each of these modules is can advantageously be surrounded by its own housing. Therefore separate replacement of one module if it is defective or in need of service can be performed quickly. The modules can, for example, be standardized and can therefore be manufactured in comparatively large series and they can, for example, have standardized interfaces and may thus also be used in other contexts (modular system). The gearbox and the rotary drive device may also be identical in design to corresponding modules in pump systems of different designs.

A single rotary drive device can, for example, be advantageously provided.

The drawings show exemplary embodiments of a pump system according to the present invention.

A first embodiment of the pump system 100 comprises a pump unit 1 of a traditional design. This pump unit 1 comprises a housing 2, with one end of a pump drive shaft 3 protruding out of the side facing the observer. The driven gear 4 of a gear wheel 5 is connected to this shaft end in a rotationally fixed manner.

The gearbox 5 serves to establish an operative connection between the pump unit and the rotary drive device 6 which comprises a rotational motor R, which is merely indicated in the drawing and may, for example, be driven either hydraulically or electrically.

The rotary drive device 6 comprises a housing 7 which is flange-mounted on the housing 2 of the pump unit 1.

One shaft end of a driven shaft 8 protrudes out of the housing 7 of the rotary drive device 6 on the side facing the user. It is connected via a shift clutch 12 to a driving gear 9, which optionally connects the driving gear 9 to the shaft end in a rotationally fixed manner or releases it. The driving gear 9 is coupled to the driven gear 4 via an intermediate gear 10 which is rotatably mounted in a housing 11 of the gearbox. Instead of the shift clutch, an elastic nonshiftable clutch may also be provided, connecting the shaft end permanently to the driving gear.

The gearing of the intermediate gear 10 engages with the gearing on the driving gear 9 and the driven gear 4. The wheels of the gearbox have helical gearing for the purpose of noise reduction.

A second embodiment of the pump system labeled as 200 as a whole also comprises a pump unit 101 of a traditional design or largely corresponding to a pump unit of a traditional design. This embodiment can also be traced back to an popular pump design.

Figure 7:
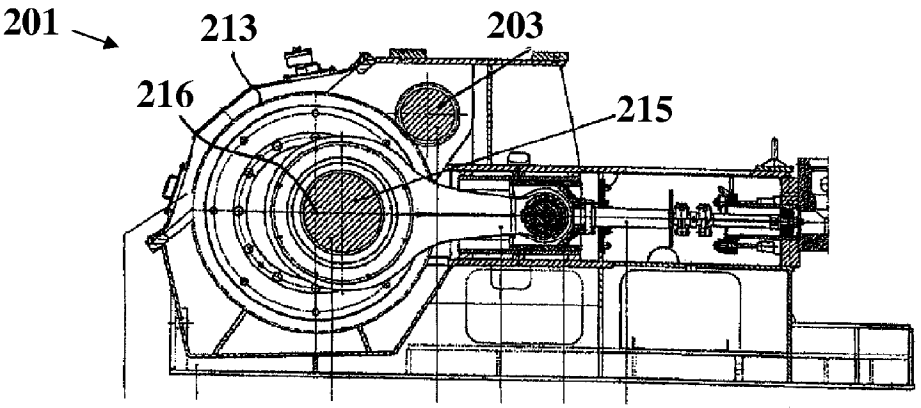
Fig. 7 Prior Art
FIG. 7 shows a sectional side view of a pump unit known from the prior art.
Figure 8:
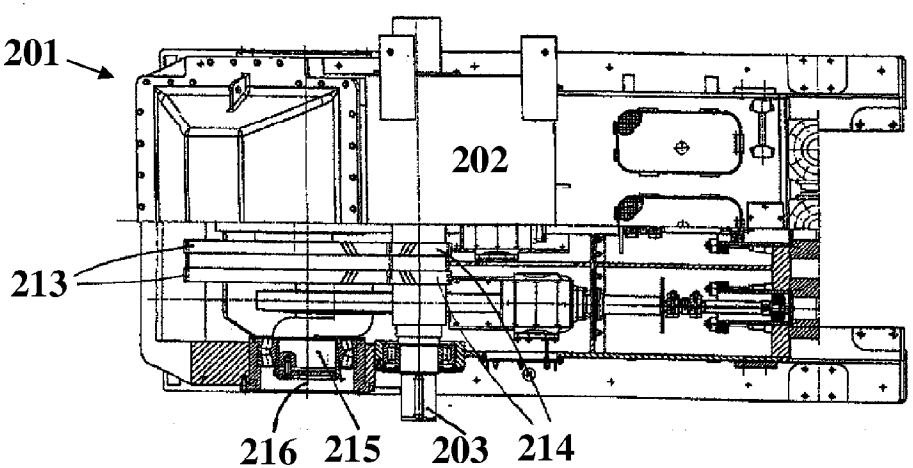
Fig. 8 Prior Art
FIG. 8 shows a partially sectional view from above of the pump unit shown in FIG. 7.

FIGS. 7 and 8 show a pump unit 201 of a traditional design and from the prior art corresponding to the pump unit 1 disclosed in the embodiment.

Figure 3:
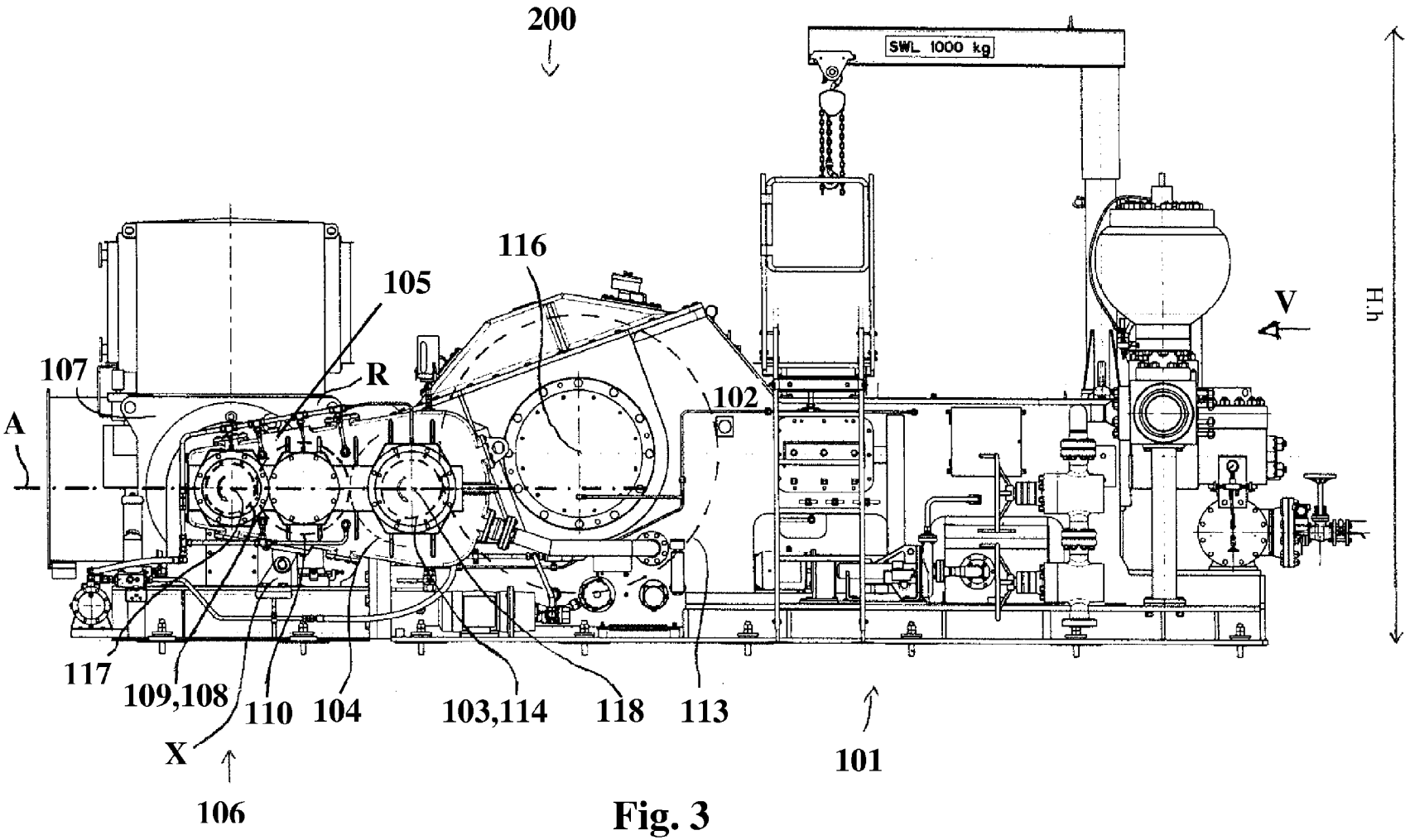
FIG. 3 shows a side view of a second embodiment of the present invention.

All the pump units 1, 101, 201 have in common the fact that they have a pump drive shaft 3, 103, 203 as well as a crank shaft 215, and the pump drive shaft is not the crank shaft. All the pump units 1, 101, 201 shown here have a housing 2, 102, 202. As shown best in FIG. 8, the pump drive shaft 3, 103, 203 has a pump drive shaft gear 114, 224 in the interior of this housing 2, 102, 202, meshing with a larger crank shaft gear 113, 213 also arranged in the interior of the housing. FIG. 3 shows the pump drive shaft 103, the pump drive shaft gear wheel 114 mounted on this shaft being indicated by a single broken-line circle, although the pump drive shaft 103 and the pump drive shaft gear wheel 114 may have a slightly different diameter, as shown in FIG. 8.

Unlike the pump unit 201 shown in FIGS. 7 and 8, the pump drive shaft 103 with the pump unit 101 of the pump system 100 of the second exemplary embodiment of the present invention is not arranged above the axis of rotation 116 of the crank shaft, but is instead beneath it. The pump drive shaft 103 is also not arranged on the side of the crank shaft axis of rotation 116 facing the other pump, but is instead arranged on the opposite side.

In the second embodiment shown in FIG. 3, the end of the pump drive shaft 103 protrudes out of the side of the housing 102 facing the observer. The output shaft 104 of the gearbox 105 is connected to this shaft end in a rotationally fixed manner. This driven gear 104 is represented in FIG. 3 by a partial circle drawn with a broken line.

The gearbox 105 serves to establish the operative connection of the pump unit 101 with the rotary drive unit 106 in the first embodiment, comprising a rotary pump R, which is only indicated in the drawing and may be driven, for example, either hydraulically or electrically. In doing so, if fulfills two functions. Firstly, it changes the rotational speed and torque of the rotational movement transmitted. Secondly, it bridges the distance between the shaft 108 of the rotary drive device and the pump drive shaft 103.

The rotary drive device 106 comprises a housing 107 which can, for example, not be flange-mounted on the housing 102 of the pump unit 101, unlike that in the first embodiment. It is not, at any rate, mounted on this housing. The rotary drive device 106 is instead arranged at the same level of the pump unit 101.

In FIG. 3, again on the side facing the observer, a shaft end of a driven shaft 108 protrudes out of the housing 107 of the rotary drive device 106. It is connected via a switch clutch 112 (compare also FIG. 4) to a driving gear 109 of the gearbox 105. The shaft 108 of the rotary drive device and the driving gear 109 of the gearbox are represented by a single broken line circle in FIG. 3 although there diameters may differ from one another. The shift clutch 112 optionally connects the driving gear 109 to the shaft end in a rotationally fixed manner or it releases this connection. The driving gear 109 is connected to the driven gear 104 via an intermediate gear 110 which is rotatably mounted in a housing 111 of the gearbox. The driving gear 109 and the intermediate gear 110 are represented by broken line circles in FIG. 3 as is the crank shaft gear wheel 113. Instead of the shift clutch an elastic nonshiftable clutch may also be provided, permanently connecting the shaft end to the driving gear.

As in the first embodiment, the gearing on the intermediate gear 110 engages with the gearing on the driving gear 109 and the driven gear 105. The wheels of the gearbox have helical gearing for the purpose of noise reduction.

The gearbox 105 in the second embodiment is mounted horizontally. The axes of the driving gear, driven gear and intermediate gear are in a horizontal plane. The gearbox has an axis of symmetry A in this plane.

Figure 4:
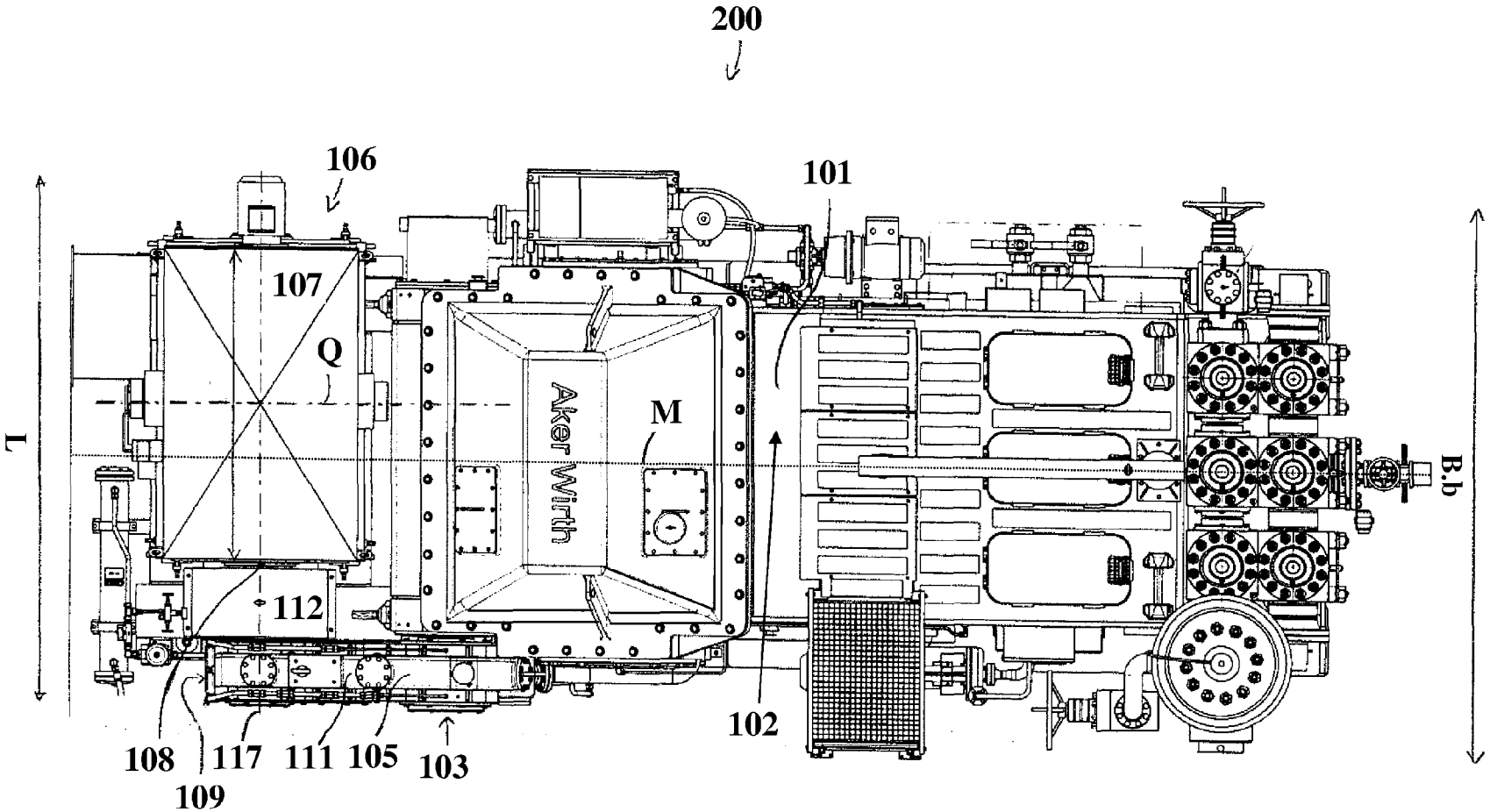
FIG. 4 shows a view from above of the embodiment shown in FIG. 3.
Figure 6:
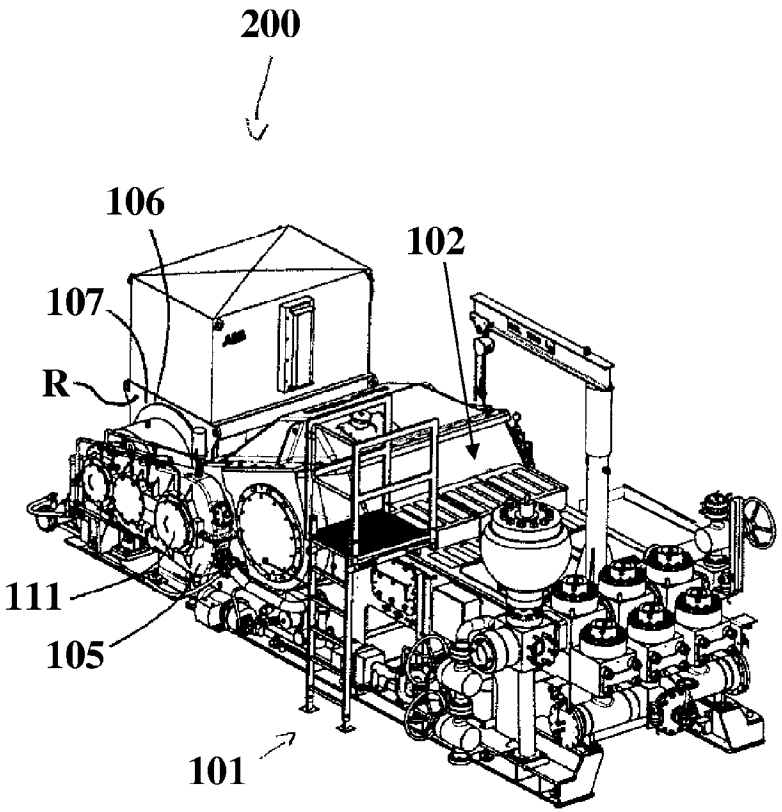
FIG. 6 shows a perspective diagram of the embodiment shown in FIG. 3 on a smaller scale.
Figure 5:
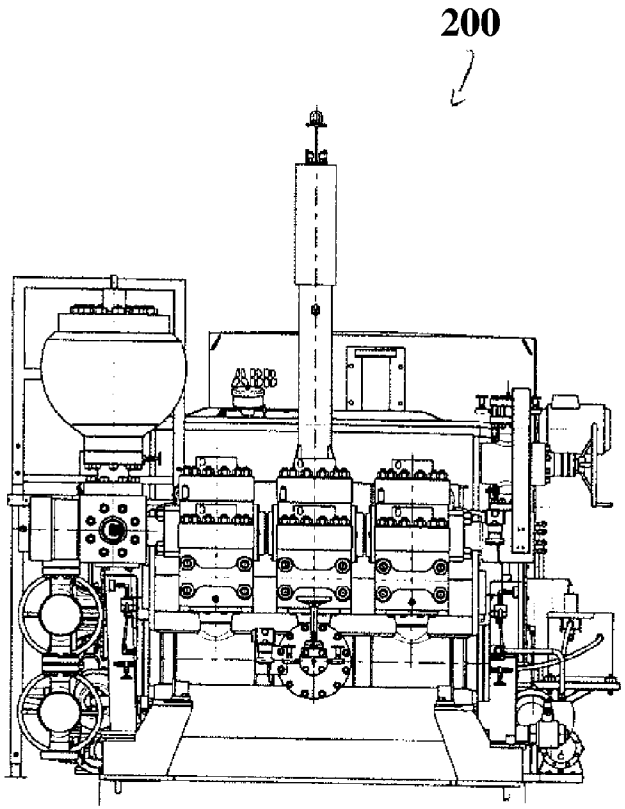
FIG. 5 shows a view from the front of the embodiment shown in FIG. 3 on a smaller scale (view V in FIG. 3)

As shown in particular by FIG. 4, the pump system 200 also has a compact design. The shape, size and arrangement of the rotary drive device 106 have been selected so that the width B of the pump system is predetermined by the width b of the pump unit 101. The rotary drive device and the gearbox plus the clutch thus do not increase the width of the pump system. The rotary drive device 106 has a greater extension 1 running in the direction of the width B of the pump system. The length of the pump system is therefore also relatively short. The greater extension 1 of the rotary drive device 106 is shorter than the width b of the pump unit by more than the width of the gearbox 105 plus the width of the clutch 112. In other words, an imaginary unit comprised of a rotary drive device, a clutch and a gearbox has a total length L, corresponding approximately to the width b of the pump unit or is only slightly smaller than that. The imaginary unit of the rotary drive device, the clutch and the gearbox therefore utilize almost the entire width B of the pump system, which is predetermined by the pump unit. The rotary drive device 106 is arranged with an offset toward one side of the pump unit 101 (upward in FIG. 4) so that this imaginary unit does not protrude significantly or at all on either side of the pump unit.

The longitudinal center line M of the pump unit 101 extends through the rotary drive device 106. The transverse center line Q of the rotary drive device 106 runs parallel to the longitudinal center line M of the pump unit 101 and extends through the pump unit 101. The longitudinal center line M of the pump unit 101 corresponds to the longitudinal center line of the pump system 200.

The gearbox 105 in all the exemplary embodiments shown here is a slip-on gear which is mounted directly on the pump drive shaft 103. For example, FIGS. 3 and 4 show that the gearbox 105 is held in position only by its connection to the clutch 112 and the pump drive shaft 103 as well as the torque support X. The gear is connected to the basic frame by means of the torque support X.

The pump system 200 is modular, i.e., based on the modular design principle in all the embodiments shown here. The modules it comprises include the pump unit, the rotary drive device, the gear and the clutch, each surrounded by its own housing. The modules are thus encapsulated and protected from rough environmental influences which prevail in the typical environment for use of the pump system.

As FIG. 3 shows, the height H of the pump system 200 is determined exclusively by the height h of the pump unit 101. The height H of the pump system 200 of the second embodiment is lower than the height of the pump system of the first embodiment.

The present invention is not limited to embodiments described herein; reference should be had to the appended claims.

LIST OF REFERENCE NUMERALS

100, 200 Pump system
1, 101, 201 Pump unit
2, 102, 202 Housing of the pump unit
3, 103, 203 Pump drive shaft
4, 104 Driven gear

5, 105 Gearbox
6, 106 Rotary drive device
7, 107 Housing of the rotary drive device
8, 108 Shaft of the rotary drive device
9, 109 Driving gear of the gearbox
10, 110 Intermediate gear of the gearbox
11, 111 Gear box
12, 112 Clutch
113, 213 Crankshaft gear wheel
114, 214 Pump drive shaft gear
215 Crankshaft
116, 216 Crankshaft axis of rotation
117 Axis of rotation of the shaft of the rotary device
118 Axis of rotation of the pump drive shaft
R Rotary motor
A Axis
B, b Width
H, h Height
L, l Length
M Longitudinal center line of the pump unit
Q Transverse center line of the rotary drive device
X Torque support

What is claimed is:

1. A pump system configured to deliver drilling fluid in at least one of a driving well and a drilling well, the pump system comprising:

a pump unit comprising a pump unit housing;

a single rotary drive device configured to drive the pump unit; and a gearbox encasing a driving gear, a driven gear, and an intermediate gear, the gearbox extending longitudinally along a side of the pump system, and the driving gear being configured to rotate around a driving gear axis, the driven gear being configured to rotate around a driven gear axis, and the intermediate gear being configured to rotate around an intermediate gear axis, wherein the rotary drive device is operatively connected to the pump unit by the gearbox, and each of the driving gear axis, driven gear axis and intermediate gear axis are arranged so as to substantially lie in a same horizontal plane.

2. The pump system as recited in claim 1, wherein the rotary drive device includes a single shaft end to which the driving gear is rotationally connected.

3. The pump system as recited in claim 2, further comprising at least one of a clutch and an elastic clutch, wherein the driving gear is connected to the single shaft end by at least one of the clutch, so as to selectively establish a rotationally fixed connection between the driving gear and the single shaft end, and by the elastic clutch, so as to establish a permanent rotationally fixed connection between the driving gear and the single shaft end.

4. The pump system as recited in claim 1, wherein within the gearbox, the driving gear and the driven gear are helical gears.

5. The pump system as recited in claim 1, wherein the rotary drive device is arranged at least at almost a same level as the pump unit.

6. The pump system as recited in claim 1, wherein each of a shape, a size and an arrangement of the rotary drive device has a width (B) which is substantially the same as a width (b) of the pump unit.

7. The pump system as recited in claim 1, wherein the rotary drive device has an extension (L) arranged in a direction of the width (B) of the pump system.

8. The pump system as recited in claim 1, wherein the pump unit further comprises a pump drive shaft.

9. The pump system as recited in claim 8, wherein the pump drive shaft is not a crankshaft of the pump unit.

10. The pump system according to claim 8, wherein the driven gear is connected to the pump drive shaft.

11. The pump system as recited in claim 8, wherein the pump unit further comprises a crankshaft with a crankshaft gear wheel, and wherein the pump drive shaft includes a pump drive shaft gear wheel, the crankshaft gear wheel and the pump drive shaft gear wheel being configured to mesh with each other.

12. The pump system as recited in claim 8, wherein the pump unit further comprises a housing.

13. The pump system as recited in claim 12, wherein the pump drive shaft is configured to protrude out of the housing.

14. The pump system as recited in claim 12, wherein the rotary drive device includes a rotary device housing, and the rotary device housing and the pump unit are at least substantially adjacent to one another.

15. The pump system as recited in claim 1, wherein the gearbox is surrounded by a gearbox housing.

16. The pump system as recited in claim 1, wherein the gearbox includes a slip-on gear.

17. The pump system as recited in claim 1, wherein the pump system is provided as a modular design with modules comprising the pump unit, the rotary drive device and the gearbox, each of the pump unit, the rotary drive device and the gearbox being surrounded by a housing.

18. A pump system configured to deliver drilling fluid in at least one of a driving well and a drilling well, the pump system comprising:

a pump unit comprising a pump unit housing;

a single rotary drive device configured to drive the pump unit; and a gearbox encasing a driving gear and a driven gear, the gearbox extending longitudinally along a side of the pump system, and the driving gear being configured to rotate around a driving gear axis and the driven gear being configured to rotate around a driven gear axis, wherein the rotary drive device is operatively connected to the pump unit by the gearbox, and each of the driving gear axis and the driven gear axis are arranged to lie in a same horizontal plane.

* * * * *